US006216375B1

(12) United States Patent
Griffin

(10) Patent No.: US 6,216,375 B1
(45) Date of Patent: Apr. 17, 2001

(54) SIGN DECORATION SYSTEM

(75) Inventor: Alan G. Griffin, Sturgeon Bay, WI (US)

(73) Assignee: Griffin Group, Inc., Green Bay, WI (US)

( * ) Notice: Subject to any disclaimer, the term of this patent is extended or adjusted under 35 U.S.C. 154(b) by 0 days.

(21) Appl. No.: 09/246,719

(22) Filed: Feb. 8, 1999

(51) Int. Cl.[7] ..... G09F 7/02
(52) U.S. Cl. ..... 40/618; 40/657
(58) Field of Search ..... 40/649, 657, 661.03, 40/661.08, 618, 5; 248/224.51, 224.61, 223.41

(56) References Cited

U.S. PATENT DOCUMENTS 3,840,261 * 10/1974 Fulkerson et al. ..... 248/224.51
4,265,040 5/1981 Sarkisian .
4,367,604 1/1983 Porter, II et al. .
4,620,736 * 11/1986 Shanks ..... 248/224.2
5,257,472 11/1993 Harnois et al. .
5,357,701 10/1994 Grate .
5,367,800 11/1994 Nelson .
5,588,238 12/1996 Visocky et al. .

* cited by examiner

*Primary Examiner*—Joanne Silbermann
(74) *Attorney, Agent, or Firm*—Donald Cayen

(57) ABSTRACT

A sign decoration system enables large eye-catching decorations to be mounted in conventional display panels that typically can accommodate only relatively small alphanumeric character plates. The sign decoration system comprises the decoration as well as a connector. The connector may comprise two components: a holder held in a display panel track, and a tab secured to the decoration. The connector tab is inserted into the connector to mount the sign decoration system to the display panel. In a modified embodiment, the decoration is permanently secured directly to a single-piece connector. In another embodiment, the connector has downwardly converging channels that interchangeably receive mating edges of different decorations. In a further modified embodiment, a large decoration spans and is held simultaneously in two tracks of the display panel without any connector.

1 Claim, 7 Drawing Sheets

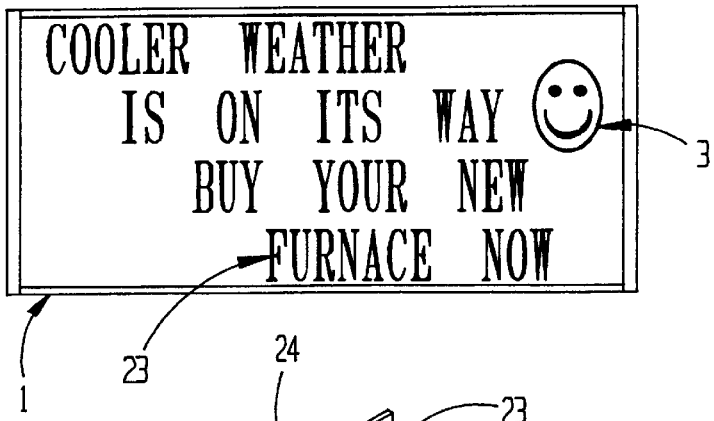
FIG. 1
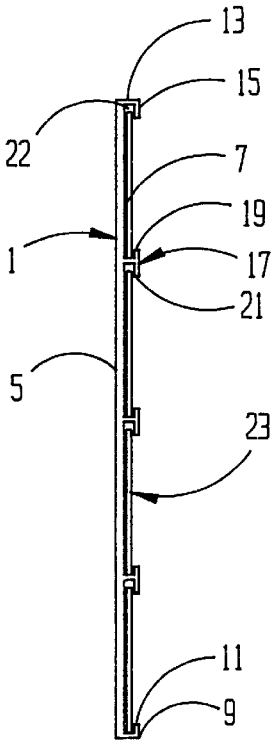
FIG. 1A
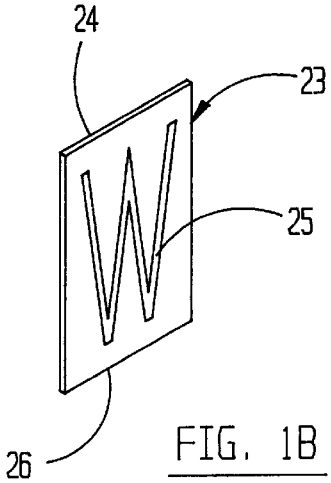
FIG. 1B
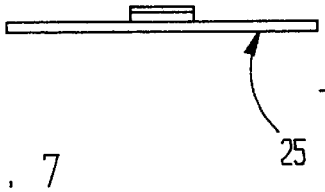
FIG. 6
FIG. 3
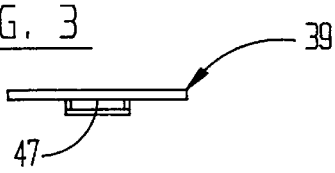
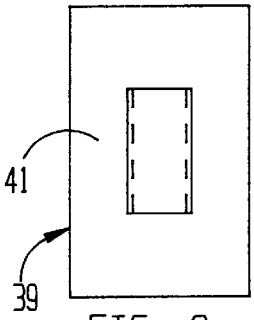
FIG. 2
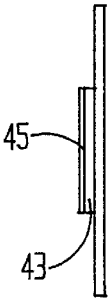
FIG. 4
FIG. 7
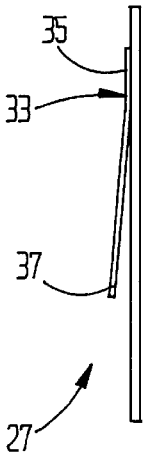
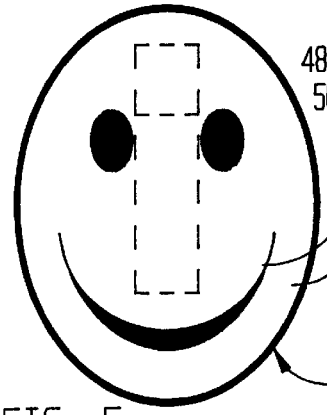
FIG. 5
FIG. 7A
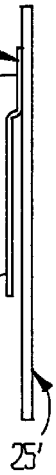

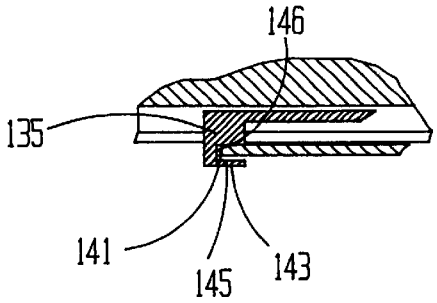
FIG. 37
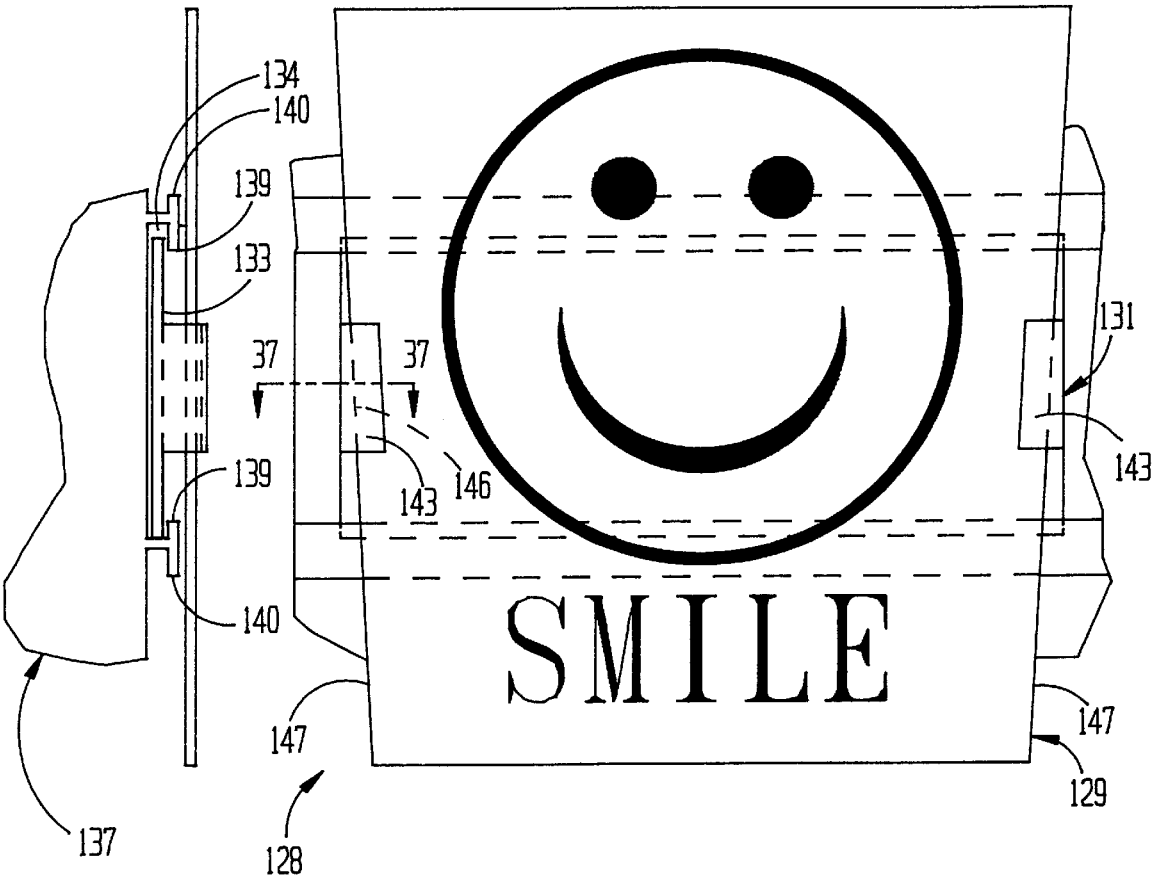
FIG. 36
FIG. 35

SIGN DECORATION SYSTEM

BACKGROUND OF THE INVENTION

1. Field of the Invention

This invention pertains to advertising, and more particularly to apparatus that enhances the appearance of alpha-numeric displays.

2. Description of the Prior Art

Various types of equipment have been developed to display commercial advertising and other promotional messages. For example, display panels that hold interchangeable characters such as numerals and alphabet letters are well known and in widespread use. Examples of prior display panels may be seen in U.S. Pat. Nos. 4,237,637; 4,265,040; 5,257,472; 5,357,701; and 5,367,800.

In some instances, the display panels are translucent or transparent such that a source of illumination can backlight the characters on the panel. U.S. Pat. Nos. 4,367,604 and 5,588,238 show backlit menu boards.

U.S. Pat. No. 5,542,202 and Des. 354,313 show representative plates that include characters for display. The plate of the U.S. Pat. No. 5,542,202 patent is especially useful with backlit display panels.

Despite the large variety of display panels, alpha-numeric characters, and character plates that are presently available, they are limited in the size and variety of graphic arts that can be handled. U.S. Pat. No. 4,367,604 shows graphic picture units, but they must be custom made to suit a particular display panel. U.S. Pat. No. 5,588,238 shows pictorial assemblies that are sandwiched between transparent window panels. The pictorial assemblies must thus be of a specific size and shape. In addition, the design of the U.S. Pat. No. 5,588,238 patent is such that it is difficult to change or rearrange the pictorial assembly after it has been created.

A further disadvantage of prior display equipment is that the numeral and alphabet letter plates are limited to use with specific tracks of a display panel. That is, the plates are all of the same height so as to fit within the tracks. Accordingly, variations in character heights in a particular track of a display panel are usually not possible.

Thus, a need exists for improvements in the way graphic materials are displayed on display panels.

SUMMARY OF THE INVENTION

In accordance with the present invention, an eyecatching sign decoration system is provided that is readily adaptable to conventional display panels. This is accomplished by apparatus that includes a connector secured to a decoration and held in the display panel.

The decoration is preferably made from a thin sheet of material such as wood, metal, or heavy paper. The decoration may be of any desired size and shape. Any desired graphic can be imprinted or otherwise applied to the decoration front face.

According to one aspect of the invention, the connector comprises a tab in the form of a thin straight strip of a strong but flexible material. One end of the strip is secured to the back face of the decoration near the top end thereof. The other end of the strip is flexible to bend about the first end. A second component of the connector is a holder having a slot that receives the free end of the strip that is secured to the decoration. The holder is sized to fit in a track of a conventional display panel in the same manner as conventional alpha-numeric character plates.

The holder and decoration can be placed at any desired location on the display panel. By inserting the strip of the decoration into the slot of the holder, the decoration is presented for view on the display panel. The decoration makes the display panel more attractive and noticeable than a display panel having only conventional characters.

In a modified embodiment of the invention, the tab on the decoration is U-shaped rather than straight. One leg of the tab is secured to the decoration, and the other leg is inserted into the holder.

In a further embodiment, the tab is L-shaped. One leg of the tab is secured to the decoration. For example, the tab first leg can project from one face of a flat plate, with the flat plate second face being secured to the decoration. The tab second leg is inserted into a suitable opening in the holder.

According to another aspect of the invention, the connector is designed as a single component in the form of a flexible generally flat plate. A center section of one face of the plate is secured to the decoration, leaving top and bottom sections unattached to the decoration. The plate is sized such that the top and bottom sections can slide within and be held in a track of the display panel in the same manner as conventional character plates.

As an alternate design, the connector is a single component having a generally C-shape. A center section of the convex side of the connector is secured to the decoration. The free ends of the connector are sized and shaped to fit over and grip the ledges that define the tracks of a conventional display panel.

As a further modification, the connector is equipped with one or more pairs of magnets or hook and eye tapes. One half of the cooperating magnets or hook and eye tapes are secured to the decoration. The other half is secured to a holder that is held in a display panel track.

In many instances, the decoration can be adequately supported in the display panel by a single connector. However, if the decoration size or shape makes it impractical to be supported with one connector, two or more connectors can be used. The connectors are secured to the decoration and held in the display panel in a manner that best suits the particular decoration.

Further in accordance with the present invention, the sign decoration system need not have a connector that is permanently secured to the decoration. Rather, the sign decoration system can be designed such that the decoration is removably secured to the connector. In that embodiment, a number of different decorations are interchangeable with a single connector. The connector has the height of a conventional alpha-numeric character plate. The connector width is substantially equal to the decoration width, which may have any practical width. The connector ends bend forwardly to make narrow channels that converge downwardly. The decoration has side edges that slide into and are held by gravity in the connector channels. Different decorations with the same side edge design can be interchangeably used with a single connector.

To further demonstrate the versatility of the present invention, a large decoration is mountable on a display panel without the use of any connector. The decoration is made of a size that spans two or more tracks. The upper edge of the decoration fits in the upper ledge of a first track of the display panel. The lower edge of the decoration fits in the lower ledge of a lower track on the display panel. In that manner, a decoration that is too large to fit in a single track can be mounted to the display panel without using any connector.

The method and apparatus of the invention, using a decoration alone, or in combination with one or more connectors, thus provides eye-catching appeal to a display panel. The connectors can be adapted to suit a wide variety of different decorations, even though the display panel is conventional.

Other advantages, benefits, and features of the present invention will become apparent to those skilled in the art upon reading the detailed description of the invention.

BRIEF DESCRIPTION OF THE DRAWINGS

FIG. 1 is a front view of a typical display panel that includes a sign decoration system according to the present invention.

FIG. 1A is an end view on an enlarged scale of FIG. 1.

FIG. 1B is a perspective view of a typical alpha-numeric character plate.

FIG. 2 is a front view of a system holder according to the invention.

FIG. 3 is a top view of FIG. 2.

FIG. 4 is a side view of FIG. 2.

FIG. 5 is a front view of a typical decoration with a tab secured thereto in accordance with the present invention.

FIG. 6 is a top view of FIG. 5.

FIG. 7 is side view of FIG. 5.

FIG. 7A is a view similar to FIG. 7, but showing an alternate embodiment of the connector of FIGS. 5–7.

FIG. 35 is a front view of a further alternate embodiment of the invention.

FIG. 36 is an end view of FIG. 35.

FIG. 37 is a cross sectional view on an enlarge scale taken along line 37–37 of FIG. 35.

DETAILED DESCRIPTION OF THE INVENTION

Figure 9:
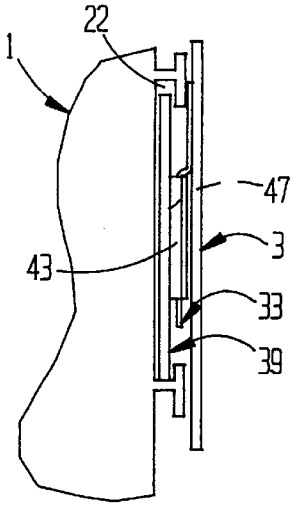
FIG. 9 is an end view of FIG. 8.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring first to FIG. 1, a typical display panel 1 is illustrated that advantageously includes the sign decoration system 3 of the invention. The display panel 1 itself is conventional and is merely representative of a wide variety of display panels for indoor and outdoor use having horizontal tracks that accept alpha-numeric character plates 23. The display panel may be translucent for back lighting purposes.

Looking also at FIGS. 1A and 1B, the particular display panel 1 shown has a wall 5 with a front surface 7. There is an L-shaped bottom ledge 9 projecting from the front surface 7. The bottom ledge 9 includes an upstanding lip 11. Another L-shaped top ledge 13 is at the top of the display panel wall 5. The top ledge 13 has a depending lip 15 that is longer than the lip 11. There are intermediate generally T-shaped ledges 17 between the top ledge 13 and the bottom ledge 9. Each intermediate ledge 17 has an upstanding first lip 19 and a second longer depending lip 21. Adjacent ledges cooperate to form tracks 22.

Reference numeral 23 represents a typical character plate that is used with the display panel 1. The plate is provided with any alpha-numeric character 25. The plate may be transparent, translucent, or opaque. The plate has a height that fits in the tracks 22 of the display panel. The plates can slide into a track from an end of the display panel. Alternately, the plates can be installed from the front of the display panel by sliding the plate top edge 24 up behind a depending lip 15 or 21, swinging the plate bottom edge 26 over the associated upstanding lip 11 or 19 and fully into the track, and lowering the plate until its bottom edge rests on the track lower ledge.

According to one aspect of the invention, the sign decoration system 3 is interchangeable with the alpha-numeric character plates 23 in the display panel 1. Turning to FIGS. 2–9, the sign decoration system is comprised of a decoration 25 and a connector 27. The decoration 25 can have any shape, size, and graphic illustration 31 on it. For example, the decoration may be made of a heavy sheet of paper 29 covered with the illustration 31 and laminated between transparent films.

The connector 27 has two components. The first component is a tab 33. As depicted, the tab 33 is a thin strip of a strong but flexible material. One end 35 of the strip is secured, as with an adhesive, to the decoration 25 on the side opposite the illustration 31. The other end 37 of the strip is bendable about the secured end 35.

The second component of the connector 27 is a holder 39. The holder 39 comprises a plate 41 that is the same size and shape, and may be made of the same material, as the alpha-numeric character plate 23 of FIG. 1B. On one surface of the plate 41 is attached a pair of spacers 43 and a cross bar 45. The plate 41, spacers 43, and cross bar 45 cooperate to define a slot 47 that is capable of receiving the tab 33 that is secured to the decoration 25.

Figure 8:
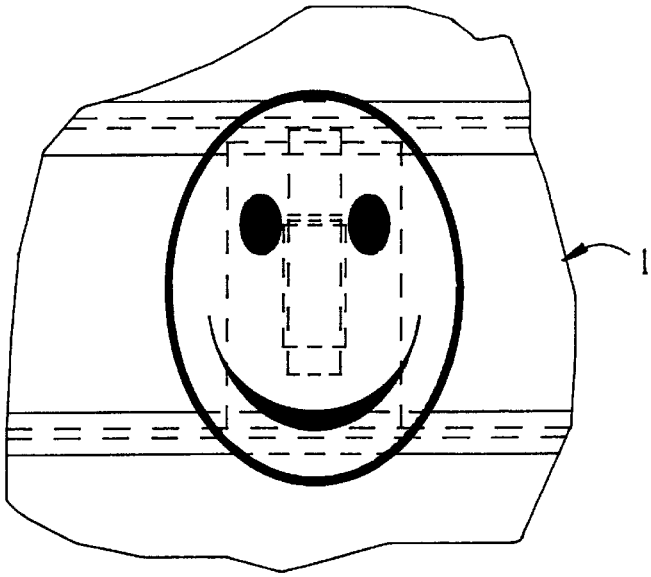
FIG. 8 is a front view of the display panel of FIG. 1 showing the decoyation system mounted thereto.

In FIGS. 8 and 9, the connector tab 33 is shown inserted into the slot 47 of the holder 39 to create the sign decoration system 3. The holder is installed in the track 22 of the display panel 1 in the same manner as a conventional character plate 23 as described in connection with FIGS. 1A and 1B. An example of a sign decoration system that works very well is the following: The decoration 25 is oval in shape, being approximately 13 inches high and ten inches wide. The tab 33 is a strip nine inches long and 1.50 inches wide. The strip first end 35 is approximately 3.75 inches long. The connector holder 39 is nine inches high. The slot 47 is two inches wide. The sign decoration system can be placed at any desired location on the display panel. Conventional-numeric character plates such as is shown in FIG. 1B can be used with the decoration to produce a very eye-catching message on the display panel (FIG. 1).

If desired, the connector tab can be made from a relatively rigid material. In FIG. 7A, the tab 48 is preformed. It has one end 50 that is secured to the decoration 25'. A second end 52 is offset from the first end 50 such that the second end can be inserted into the slot 47 of the holder 39 in a manner similar to that shown in FIGS. 8 and 9.

Figure 12:
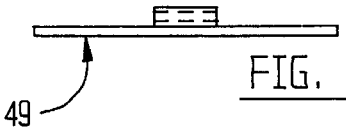
FIG. 12 is a top view of FIG. 10.
Figure 11:
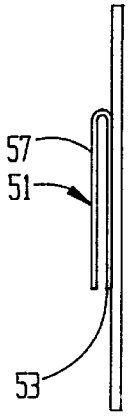
FIG. 11 is an end view of FIG. 10.
Figure 10:
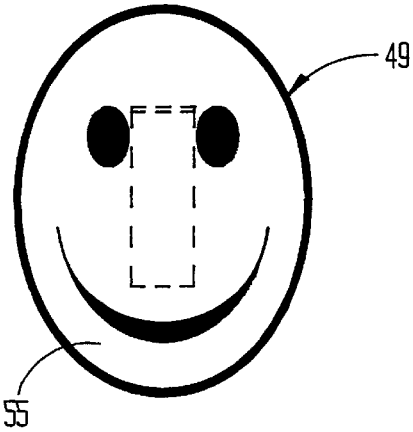
FIG. 10 is a front view of a typical decoration with a modified tab secured thereto.

A modified embodiment of the invention is shown in FIGS. 10–12. A decoration 49 has a connector tab 51 that is U-shaped. One leg 53 of the tab 51 is secured to the decoration sheet 55. The other tab leg 57 is sized to fit within the slot 47 of the holder 39 of FIGS. 2–4. Thus, the decoration 49 is installed in the display panel 1 in generally the same manner as the decoration 25, FIGS. 8 and 9.

Figure 14:
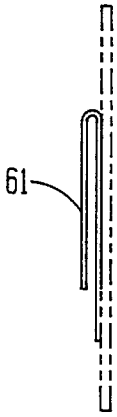
FIG. 14 is an end view of FIG. 13.
Figure 13:
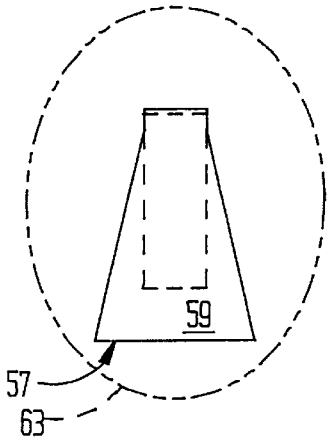
FIG. 13 is a front view of a further modified tab.

In FIGS. 13 and 14, a U-shaped tab 57 has one leg 59 that is much larger in area than the second leg 61. The leg 59 is secured, as by bonding, to the decoration 63. The large area of the tab leg 59 provides increased stability to the decoration 63 for outdoor applications.

FIGS. 15–20 show a further modified sign decoration system 65 comprising a decoration 67 and a connector 71. The connector 69 is made of a tab 71 and a holder 73. The tab 69 is made as a thin plate 75 with an L-shaped leg 77. One end 79 of the leg 77 is joined to the plate 75. The second leg end 81 of the tab leg is received in an opening 83 of the holder 73. The holder opening 83 is defined by a tubular length 85 that lies alongside and is joined to a holder plate 87.

Figure 20:
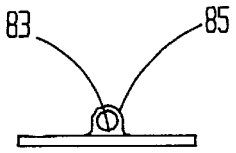
FIG. 20 is a top view of FIG. 18.
Figure 16:
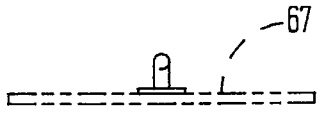
FIG. 16 is a top view of FIG. 15.
Figure 18:
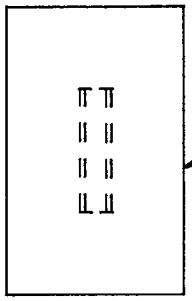
FIG. 18 is a front view of a holder that is used with the tab of FIGS. 15–17.
Figure 19:
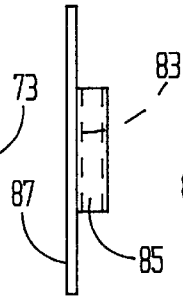
FIG. 19 is an end view of FIG. 18.
Figure 17:
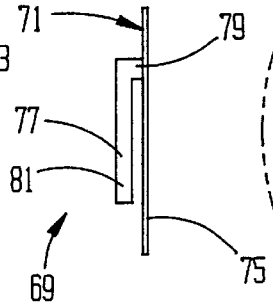
FIG. 17 is an end view of FIG. 15.
Figure 15:
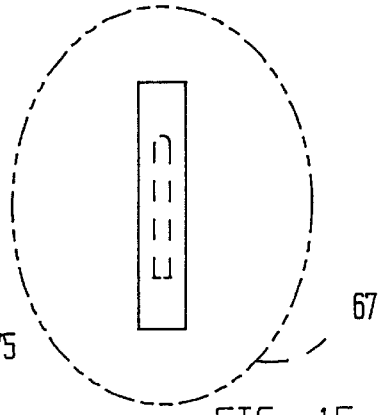
FIG. 15 is a front view of a modified embodiment of a tab.

In FIGS. 16 and 20, the cross-sections of the tab leg end 81 and of the holder opening 83 are shown as being circular. However, it will be appreciated that square or other cross-sectional shapes can be used as well as circular.

Figure 22:
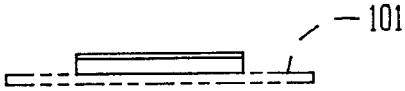
FIG. 22 is a top view of FIG. 21.
Figure 23:
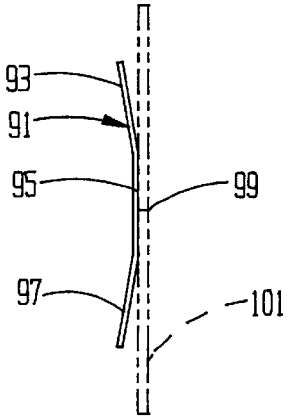
FIG. 23 is an end view of FIG. 21.
Figure 21:
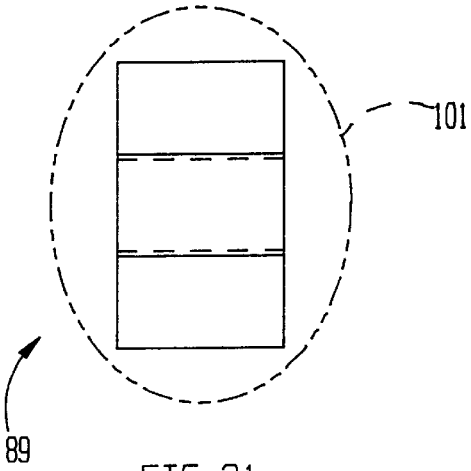
FIG. 21 is a front view of a modified connector according to the invention.

Now turning to FIGS. 21–23, a sign decoration system 89 is depicted in which the connector 91 has a single component. The connector 91 is a plate having a top section 93, a center section 95, and a bottom section 97. The height of the connector 91 is the same as the height of the holder 39 of FIGS. 2–4 and of the holder 73 of FIGS. 18–20. One surface 99 of the center section 95 is secured to the decoration 101. The sections 93 and 97 are free to bend relative to the center section 95 in the same manner as the end sections 37 of the tab 33 (FIGS. 5–7). The sign decoration system 89 is mounted on the display panel by sliding the connector 91 in the tracks of the display panel from an end thereof, or by the tilting and lowering method described previously in conjunction with the plate 23 of FIGS. 1A and 1B.

Figure 23A:
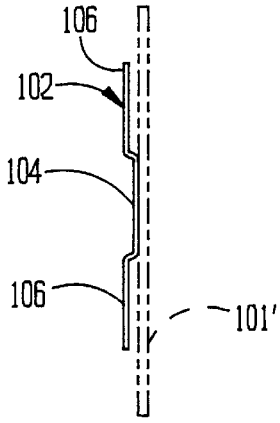
FIG. 23A is a view similar to FIG. 23, but showing an alternate embodiment of the connector.

The connector 91 of FIGS. 21–23 need not be made from a flexible material. In FIG. 23A, an alternate connector 102 is made of a relatively rigid material. The connector 102 has a center section 104 that is secured to the decoration 101'. The connector top and bottom sections 106 are offset from the center section 104. The connector 102 has a size and shape that enables it to be assembled into a track 22 of a display panel (FIG. 9).

Figure 25:
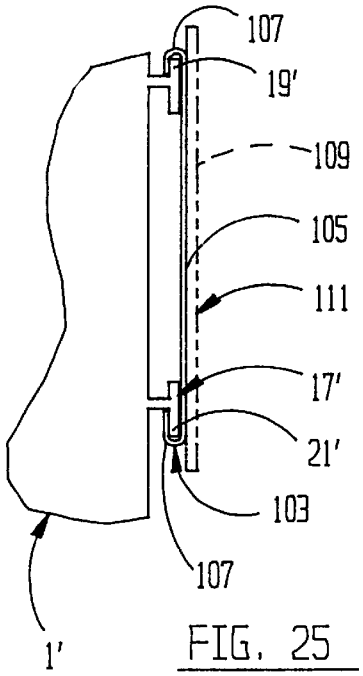
FIG. 25 is a n end view of FIG. 24.
Figure 24:
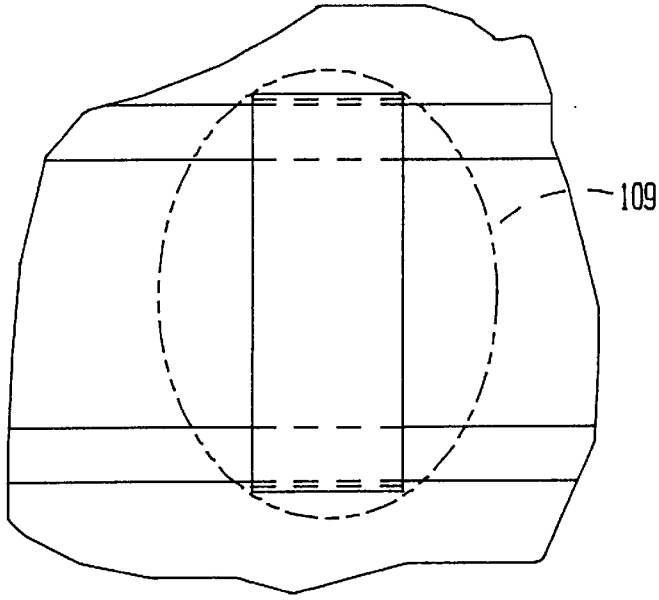
FIG. 24 is a front view of a further modified connector for holding a decoration to a display panel.
Figure 27:
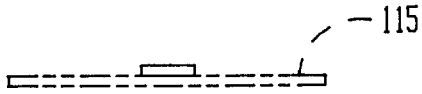
FIG. 27 is a top view of FIG. 26.
Figure 30:
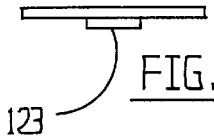
FIG. 30 is a top view of FIG. 29.
Figure 29:
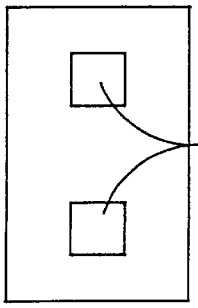
FIG. 29 is a front view of a holder that is used with the decoration of FIGS. 26–28.
Figure 31:
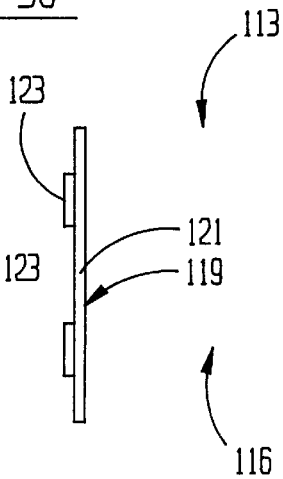
FIG. 31 is an end view of FIG. 29.
Figure 28:
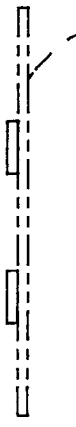
FIG. 28 is an end view of FIG. 26.
Figure 26:
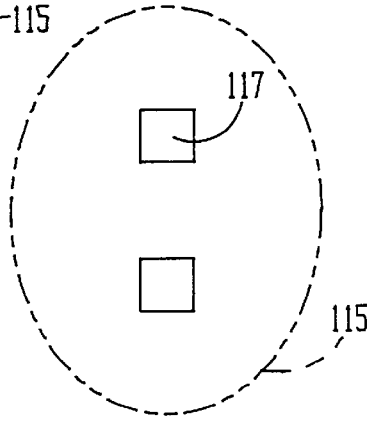
FIG. 26 is a front view o f a decoration in combination with another alternative connector.

FIGS. 24 and 25 depict a connector 103 that is a single component. The connector 103 is generally C-shaped, having a long center section 105 and opposed end sections 107. The end sections 107 are shaped as bent-over legs that are located and sized to slidingly fit over the lips 19' and 21' of the display panel 1'. The connector center section 105 is secured to a decoration 109 to make a sign decoration system 111. The sign decoration system 111 is mounted by sliding the connector over the lips 19' and 21' from the ends of the display panel ledges 17'.

Another sign decoration system 113 according to the invention is illustrated in FIGS. 26–31. The sign decoration system 113 has a connector 116 that includes one or more magnets 117 secured to a decoration 115. The connector 116 further comprises a holder 119. The holder 119 is fabricated as a plate 121 similar to the alpha-numeric character plate 23 of FIG. 1B. One or more additional magnets 123 are secured to the plate 121. Accordingly, the decoration 115 is assembled to the holder by means of the magnets 117 and 123. If desired, cooperating patches of hook and eye tape can be substituted for the magnets.

Figure 34:
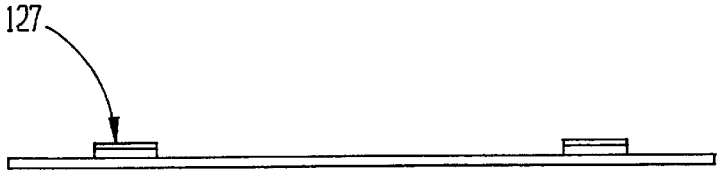
FIG. 34 is a top view of FIG. 32.
Figure 33:
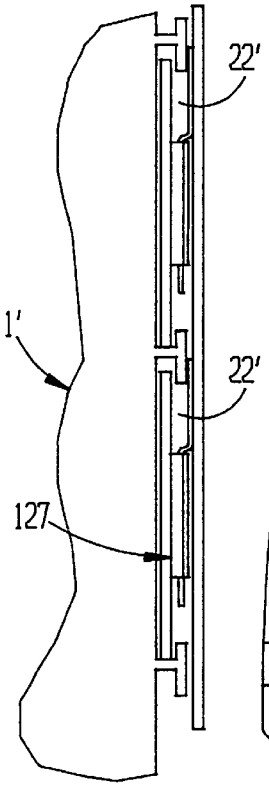
FIG. 33 is an end view of FIG. 32.
Figure 32:
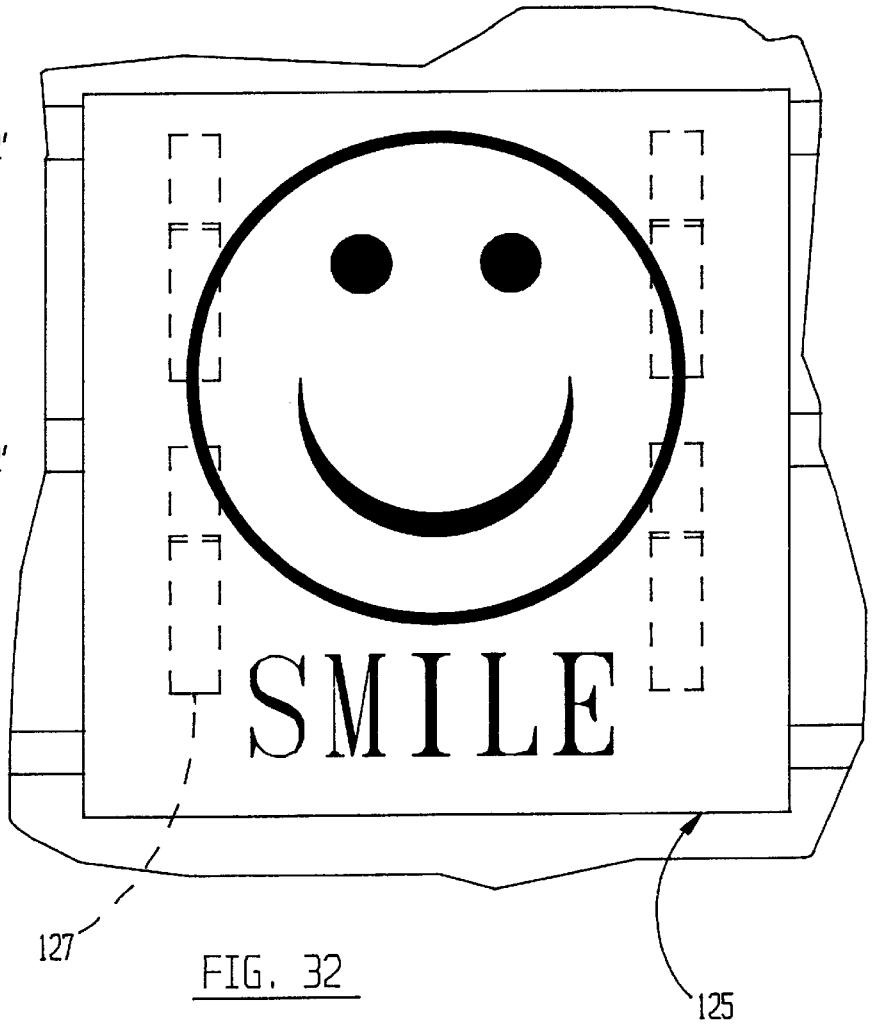
FIG. 32 is a front view of a large decoration with more than one connector.

Further in accordance with the present invention, the size of the decoration is not limited by the size of the connector or of the display panel tracks. Turning to FIGS. 32–34, a decoration 125 is shown that is relatively large compared with the display panel tracks 22'. To mount the large decoration 125 to the display panel 1', more than one connector is used. As shown, four connectors 127 are used. The connectors 127 in FIGS. 32–34 are the same as the connector 27 of FIGS. 2–7. However, it will be appreciated that any of the other connectors 69, 91, 103, or 116 of the invention can be used with the decoration 125. In addition, the number of connectors, as well as their locations on the decoration, can be varied to suit the particular size and shape of the decoration.

It is a feature of the present invention that the connector need not be permanently secured to the decoration. Rather, as shown in FIGS. 35–37, a sign decoration system 128 comprises a decoration 129 that is removably secured to a connector 131. The connector 131 has a plate section 133 that has a height suitable for being held in a track 134 of a conventional display panel 137. The plate section 133 can be of any width to suit the particular decoration 129. At each end of the plate section is a pad 135. The pads 135 are between the lips 139 of the display panel ledges 140 when the connector is held in the display panel 137. Each pad has a locating surface 141 that is forwardly of the display panel ledges 140. The pad locating surfaces 141 cooperate with bent-over ends 143 to form a channel 145 on each end of the connector. The channels 145 are thus located forwardly of the display panel ledges. The channels have respective side edges 146 that converge slightly in the downward direction.

The decoration 129 has a width between side edges 147 that suits the width of the connector 131. The decoration side edges 147 converge downwardly at the same angle as the side edges 146 of the connector channels 145. The decoration is slipped into the connector channels until a wedging action is made between the side edges 146 and the decoration side edges 147. At that point, the sign decoration system 128 is firmly mounted to the display panel 137. Any of a number of decorations can be interchangeably assembled to a single connector, which remains held in the display panel. A typical sign decoration system 128 has a decoration that is 20 inches high and 18 inches wide across the top. The holder channels 145 and decoration side edges 147 converge at a five degree included angle.

Figure 39:
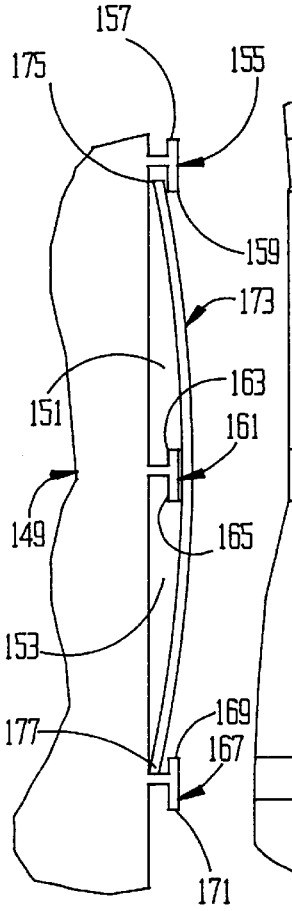
FIG. 39 is an end view of FIG. 38.
Figure 38:
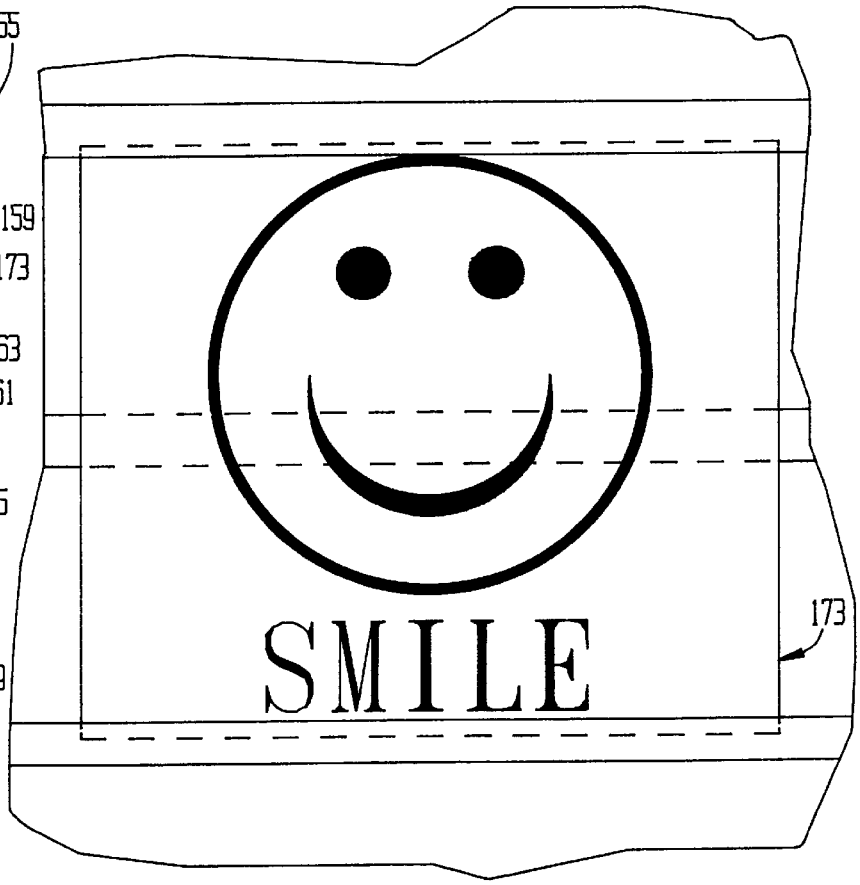
FIG. 38 is a front view of a sign decoration system that requires no connector.

The versatility of the present invention is further demonstrated with reference to FIGS. 38 and 39. Reference numeral 149 represents a conventional display panel having two tracks 151 and 153. The track 151 is defined by an upper ledge 155 having an upper lip 157 and a longer lower lip 159, and by a center ledge 161 having lips 163 and 165. The display panel track 153 is defined by the center ledge 161 and by a lower ledge 167 having an upper lip 169 and a longer lower lip 171.

A decoration 173 has a height that is greater than the heights of the individual display panel tracks 151 and 153. ordinarily, the decoration 173 would not be mountable in the display panel 149 without using one or more of the connectors 27, 69, 91, 102, 103, 116, or 131 described previously. However, the decoration 173 is designed with a height that substantially spans both tracks 151 and 153 as well as the ledge 161. Specifically, the decoration height is chosen such that the decoration upper edge 175 fits behind the lower lip 159 of the ledge 155. At the same time, the decoration lower edge 177 fits behind the upper lip 169 of the ledge 167. The decoration is made of a material flexible enough to permit it to bend slightly to pass in front of the center ledge 161. As used in one commercially available display panel 149, the decoration 173 has a height of 20 inches and a width of 16 inches. It will be understood, of course, that the decoration can be constructed to span three or more tracks, if desired.

In summary, the results and advantages of display panels, both indoor and outdoor, can now be more fully realized. The sign decoration system of the invention provides both eye-catching appeal and versatility to display panels. This desirable result comes from using the combined functions of the connectors. According to one aspect of the invention, the connector comprises a single component. In that case, the connector is more or less permanently secured to the back side of a decoration, which may be any of a wide variety of decorative graphics or other artwork. The connector and decoration constitute a unitary system that is complete in itself. The holder is held in the display panel in the same manner as conventional alpha-numeric character plates used with the display panel for displaying written messages. Alternately, the connector may be in two pieces: a tab secured to the decoration, and a holder held in the display panel. Any of a number of different decorations can be used interchangeably with a holder. Accordingly, the holder need not be removed from the display panel in order to change the decoration. According to another aspect of the invention, the connector and decoration are not permanently secured to each other. The decoration is removeably secured to the connector by a wedging action such that many different decorations can be interchangeably secured to the connector. The sign decoration system is further characterized by a large decoration that needs no connector to mount it to a display panel.

It will also be recognized that in addition to the superior performance of the sign decoration system, its construction is such as to cost little more than traditional alpha-numeric character plates installed on display panels. Moreover, since the sign decoration system is made of rugged components and according to a simple design, it will give a long service life with minimal maintenance.

Thus, it is apparent that there has been provided, in accordance with the invention, a sign decorating system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A sign decoration system for use with a display panel having at least two ledges that cooperate to define a track comprising:

a. a decoration having opposed side edqes that converge downwardly at a predetermined angle; and b. a holder comprising a plate having a size and shape that enables it to be removably held in the display panel track, the holder further comprising opposed ends that define respective channels having side edges that converge downwardly at the predetermined angle, the holder channels removeably receiving the decoration side edges to thereby removeably mount the decoration to the display panel, wherein the holder is formed with a pair of locating surfaces that cooperate with the holder channels to locate the decoration forwardly of the display panel ledges.

* * * * *